US005603200A

United States Patent [19]

Calvano

[11] Patent Number: 5,603,200

[45] Date of Patent: Feb. 18, 1997

[54] METHOD FOR THE MANUFACTURING OF AN AIRTIGHT, RECYCLABLE AND BIODEGRADABLE PACKAGE

[76] Inventor: Ferrucchio C. Calvano, Estomba 150, C.P. 1427, Capital Federal, Argentina

[21] Appl. No.: 330,702

[22] Filed: Oct. 28, 1994

[30] Foreign Application Priority Data

Oct. 28, 1993 [AR] Argentina ..... 326.421

[51] Int. Cl.[6] ..... B65B 43/10; B65B 55/10

[52] U.S. Cl. ..... 53/452; 53/426; 53/467; 53/456

[58] Field of Search ..... 53/452, 456, 467, 53/426, 563, 558, 565

[56] References Cited

U.S. PATENT DOCUMENTS

| | | | |
|---|---|---|---|
| 2,176,147 | 10/1939 | Palmer | 53/456 |
| 2,342,198 | 2/1944 | Hultin | 53/456 X |
| 3,280,531 | 10/1966 | Meyer-Jagenberg | 53/456 X |
| 4,506,491 | 3/1985 | Joosten et al. | 53/456 X |
| 5,154,041 | 10/1992 | Schneider | 53/456 |

*Primary Examiner*—James F. Coan
*Attorney, Agent, or Firm*—Stroock & Stroock & Lavan

[57] ABSTRACT

A method for manufacturing an airtight, recyclable, biodegradable package includes the steps of stamping a cardboard sheet to mark the folding lines which define the lateral walls, the top walls and the bottom of the package as well as adhesive bands. The sheet is then sterilized. A fast drying adhesive substance is applied on the adhesive bands between the walls. The cardboard sheet is then folded so that the adhesive bands overlap each other in pairs forming a tube. The ends of the tube are closed by folding the bottom walls making a flat base. The top walls are folded to seal the tube. The adhesive in the adhesive bands becomes activated to form a closed airtight package.

11 Claims, 6 Drawing Sheets

C
D
E
B
II
III
IV
1
1'
2
2-2'
5
6
7
15
17
23
31
33
34
a

V
VII
IV
35
36
24
24'
30
30'
38'
31''
I
H
G
F
R
S
T
Q
I'

M
37
30
35
24
L
K
J
31'
I
N
O
P
24'
V
VII

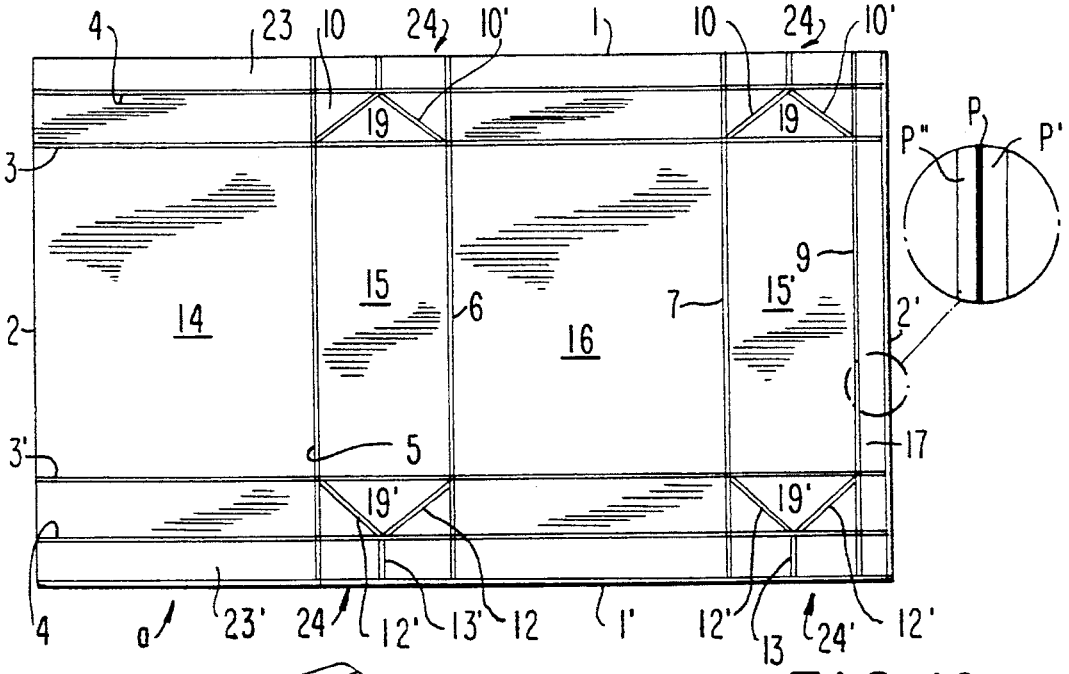
FIG. 10
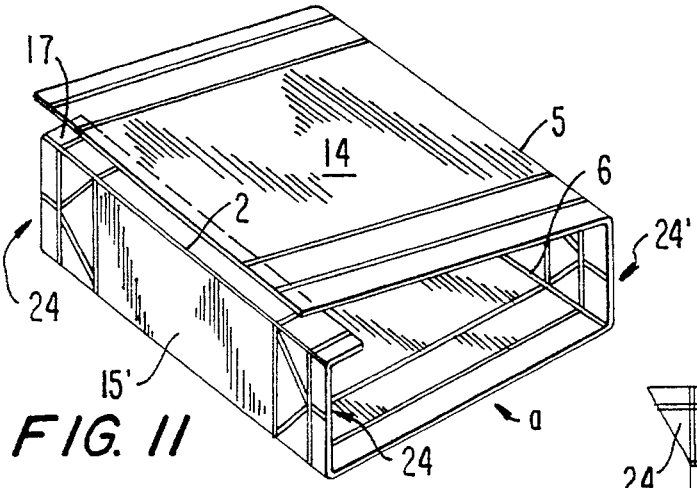
FIG. 11
FIG. 12
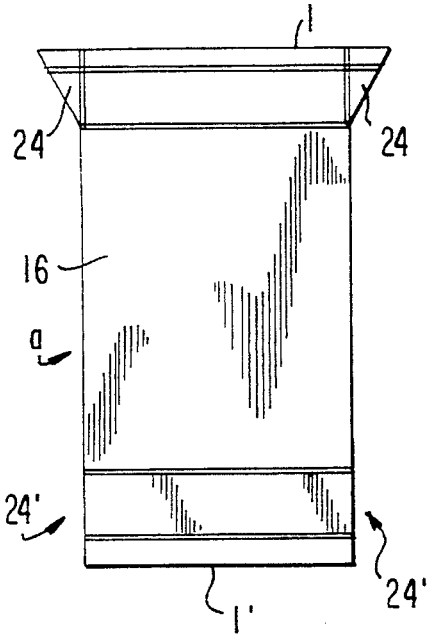
FIG. 13
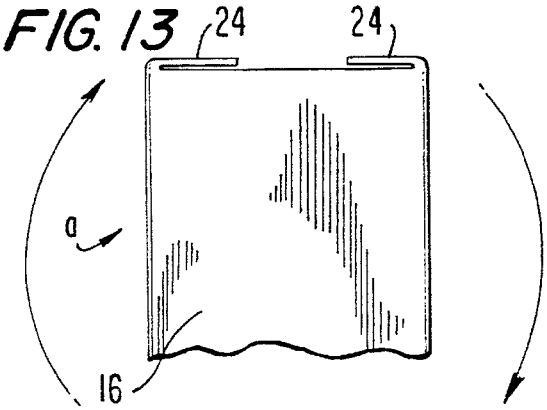

METHOD FOR THE MANUFACTURING OF AN AIRTIGHT, RECYCLABLE AND BIODEGRADABLE PACKAGE

BACKGROUND OF THE INVENTION

This invention relates to the means used in the manufacturing of airtight packaging in general, and more specifically it relates to a method for the manufacturing of an airtight package which is not only recyclable but also biodegradable.

Sachets are widely used in order to pack all kinds of consumer products. Said sachets are a tube-shaped waterproof bag, closed by cross stitching in both its ends.

This kind of packaging, although it is low-cost, poses a series of problems and drawbacks. It may be easily punctured or damaged; stacking is extremely difficult due to its shape; it can not stand on its base, and this, in turn, makes handling difficult.

Similarly, multilayer-packaging is also widely used. Multilayer-packaging consists of a cardboard piece (a) lined by layers made of either aluminium or plastic, or other materials.

Contrary to the former, this kind of packaging, can hold all sorts of products, keeping them in excellent conditions and at relatively low cost.

Moreover, in the case of consumer foods, this kind of packaging is resistant enough, easy to open and easy to use when serving (as the folded lugs in its top wall have a funnel-like shape when open). Furthermore, the material it is made of guarantees an airtight closing; it is not polluting, and neither the nutritional properties of the foods packed in them nor the taste thereof will ever be affected.

On the other hand, another advantage of this kind of packaging, is that it is prismatic and rectangular, which not only remarkably enables the handling thereof but also allows it to stand safely on its flat base, and makes stacking easier even if storage space is limited or small.

However, the above mentioned multilayer packaging poses a serious drawback, which in the light of the current ecological trends and guidelines towards preservation, should be taken into account.

In fact, as this packaging consists of aluminium sheets and plastic layers, once it is used it can not be recycled, and most important of all, it is not biodegradable.

The aforesaid means that, although this kind of packaging has contributed significantly, it is a real polluting factor, specially due to the fact that, as it is used for mass consumption products, it becomes a part of the huge mass of pollutants which contaminate the soils, the environment, and is impossible to dispose of.

The invention that this description relates to has solved all these drawbacks in a very easy and ingenious way, since this package embodies all the advantages of the others, but apart from that is not polluting, it is both recyclable and biodegradable.

Because of this, it is reasonable to predict how successful this invention will turn out to be, irrespective of the category or use it may have, as it can be used for the packaging of any kind of solid products, granules or dusts etc.

FIGURES

In order to better understand the objective of this invention, a series of figures follow in one of the preferred embodiments. It will be apparent that variations are possible without departing from the scope of the invention herein defined.

FIG. 10 is a top view of a sheet stamped to shape the cardboard packages (a), where possible optional layers made of biodegradable materials are also shown.

FIG. 11 shows how the cardboard sheet is to be folded (a) in order to shape the lateral walls of the package.

FIG. 12 is a lateral view of the package which shows the bottom wings as they are about to be closed.

FIG. 13 shows a part of the package in detail, lying upside down, as it is indicated by the arrow, in order to shape the final bottom.

Figure 1:
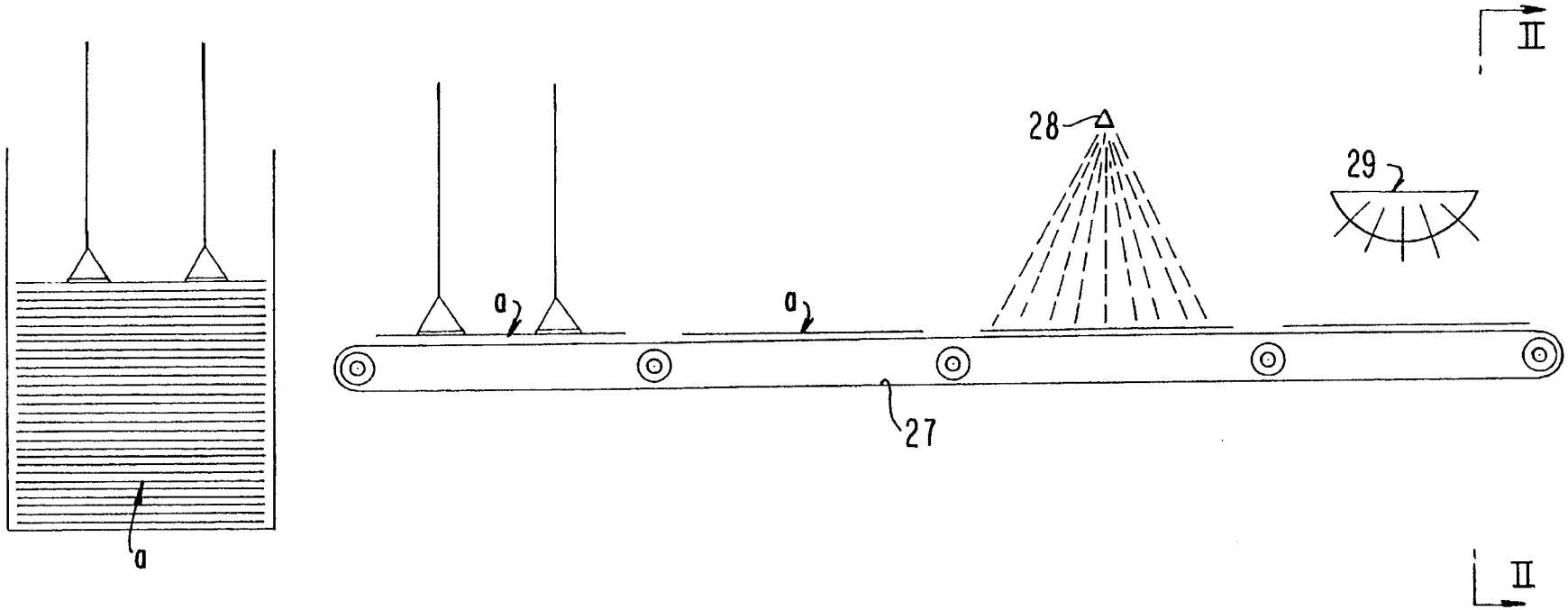
FIG. 1 shows a diagram of the first production step, which corresponds to the feed-in of the cardboard (a) from a stack, including the sterilization step and the drying step.

MAIN REFERENCE LIST (a) cardboard sheet (a) used for manufacturing the package.

(A) sterilization step of (a)

(B) gluing step (C) folding and lateral shaping step (D) lateral closure press step (E) rotation (F) lateral shaping (G) lateral shaping (H) bottom preparation (I) bottom folding step (J) bottom folding and gluing (K) adhesive spreading on the bottom (L) bottom wing pressing (M) bottom wing pressing (N) package filling step (with the product)

(O) opening wing folding, preparing the closure (P) opening wing folding (Q) stretching of the opening wings (R) application of lateral adhesive to fix the opening wings (S) opening wing folding and gluing (final closure)

(T) closed package, last step of the manufacturing process (1) longitudinal bottom edge in (a)

(1') longitudinal edge of filling mouth in (a)

(2) external cross edge of (a)

(2') internal cross edge of (a)

(3) first folding longitudinal line (3') second folding longitudinal line (4) third and fourth folding longitudinal lines (5) first cross folding line (6) second cross folding line (7) third cross folding line (8) fourth cross folding line (9) fifth cross folding line

(10) first oblique bottom folding lines (10') second oblique bottom folding lines

(11) fold convergence extension of folds (10) and (10')

(12) filling mouth first oblique folding lines (12') bottom fold second oblique lines

(13) fold convergence extension of folds (12) and (12')

(13') folds convergence extension of folds (12) and (12')

(14) whole main wall

(15) first transversal lateral wall (15') second transversal lateral wall

(16) first principal half-wall (linked to (16')

(16') second principal half-wall (linked to (16)

(17) linking band between (16) and (16'), shaping the basic box tube

(18) whole bottom stripe (18') whole lid stripe

(19) triangular sectors of fold in the bottom (19') triangular sectors of fold in the lid

(20) first bottom half-stripe (linked to (20')

(20') second bottom half-stripe (linked to (20)

(21) first lid half-stripe (linked to (21')

(21') second lid half-stripe (linked to (21)

(23) longitudinal lid closing brims

(24) bottom (24') lid

(25) package load (solid product)

(26) feed-in cardboard (a) coil

(27) guiding rollers

(28) sterilization cask or barrel (28') sterilization wash

(29) drier

(30) tractor roller

(31) thermo-activating adhesive applicators (31') adhesive applicators for the bottom lugs (31") adhesive applicators for lid lugs

(32) cutting blades

(33) shaping mandrel (for the shaping of the tube)

(34) press

(35) shaped prismatic tube

MAIN OBJECTIVE OF THE INVENTION

Method for the Manufacturing of an Airtight, Recyclable and Biodegradable Package A kind of package which is made form a cardboard sheet (a), and consists of: lateral walls, (14, 15, 15', 16) which are linked (14-2) in a tube-like shape (30), unfolding walls (18, 19, 20, 23) in the bottom (24) which by means of dotted lines (3, 4, 5, 6, 7) and folds (10, 10', 11) close one of the ends of the abovementioned tube (30) thus shaping a container for the product (25), which is the load of said package, and top walls (18', 19', 21, 21') which—with the corresponding folding lines (3', 4, 5, 6, 7, 9) and folds (12, 12', 13)—close the other end of the tube (30), in such a way that the packed product (25) is occluded inside the package. It is characterized in that: a cardboard sheet (a) stamped to mark the folding lines (5, 6, 7, 9, 3, 3') which limit the lateral walls (14, 15, 15', 16) the top walls (24) and the bottom (24'), as well as the adhesion stripe (17) between walls (16, 15'); said sheet (a) is sterilized (A); a fast-drying and reactivating adhesive substance is applied on the predetermined parts between walls; (31, 31', 31") the cardboard (a) sheet (a) with the adhesive stripe (17) is folded making it overlap with the corresponding lateral wall of the package (14, 15, 15', 16) form a tube (30), as well as the closure of the ends (23, 23') of said tube (30) by means of a folding of the back walls (18, 19, 20, 20', 23) (24) shaping a flat base, and after filling the package with the product (25), the top walls (18', 19', 21, 21', 23) are closed in the same way, and define the airtight closure of the package with the contents thereof; the adhesive substance in the overlapping areas (17, 31, 31', 31") of the stripes that have been glued is activated.

DESCRIPTION

In general terms, the reference procedure starts with a cardboard sheet (a), paperboard sheet (a), o similar material, stamped with a rectangular shape limited by the bottom longitudinal edge (1), opening longitudinal edge (1'), external transversal edge (2), and internal transversal edge (2'). All of the aforesaid are the borders of each sheet (a) (FIG. 10) and can be made of ordinary cardboard, paperboard, (P) o can be lined with protective layers (P) and (P") of paraffin or any other adequate material, according to the detail shown in FIG. 10; whereas the stamping defines the following folding lines:

longitudinally, parallel to borders (1) and (1'); the first longitudinal folding line (3) proximal border (1); the second longitudinal folding line (3') proximal border (1'); the third and fourth longitudinal folding lines (4) inserted between (1) and (3), and between (3') and (1'), respectively.

transversally, parallel to borders (2) and (2'); the first cross folding line (5) proximal border (2); second, third, fourth and fifth cross folding lines (6), (7), and (9), respectively, the latter being proximal border (2'), to define a thin stripe or adhesive band (17). These folding lines (5-6-7-9-4-3') are to define the first and second lateral walls (15) and (15'), the principal wall (14) which is only one piece, and the second wall across from it (16). Between the folding lines (9) and (2') there is an adhesive band (17) which is linked to the principal wall (14); whereas from both ends of the transversal walls (15) and (15') the sheet affects the first and second oblique bottom (24) folding lines (10) and (10') which give shape to triangular surfaces (19) and, from its free vertex link the longitudinal brim (1) with the proximal line (4) by means of extension transversal lines (11) crossing over the longitudinal brim (23); likewise, the opposite top wall or entry wall (24') is linked with the oblique lines (12) and (12'), resulting in triangular surfaces (19') and extension transversal lines (13) and (13') which, in turn, cross over to the other adhesive brim (23') (FIGS. 10 to 13) as it is shown in the top walls (24') and the bottom walls (24) of the corresponding packages; as well as the overlapping bands of the walls which are glued and therefore shape the final package. Said bands are flanges located adjacent to the rims of each sheet which will be used to make a new package.

The reference procedure consists of the following steps:

A cardboard sheet (a) is stamped in a continuous form during the sterilization step (A) of said sheet (a), by washing it in sodium peroxide, or by spraying it with sodium peroxide and drying it by means of heat (29).

The sheet (a) moves along a conveyor belt (27) while it is dried with a drier (29).

Figure 16:
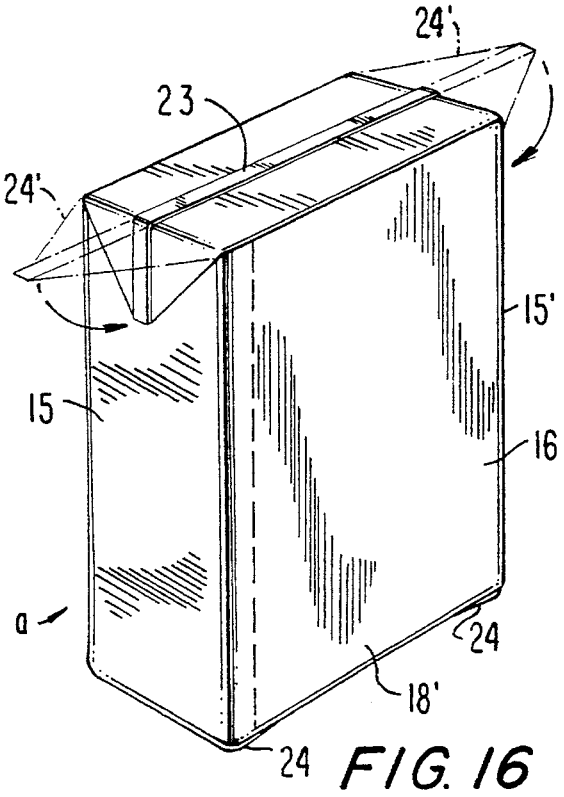
FIG. 16 is a perspective view which shows how the lugs are folded; and finally
Figure 17:
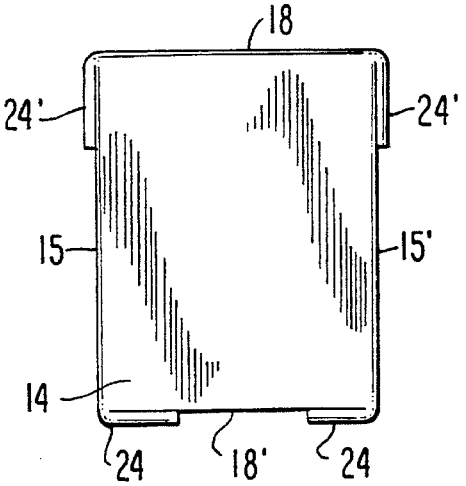
FIG. 17 shows an elevation view of an empty package. In all of the abovementioned figures, the same numbers indicate equal parts or matching parts, and the sets of elements have been marked by letters.

Upon completion of this step (FIG. 2), a fast-drying, thermo-activating adhesive substance, such as joiner's glue, is applied on the predetermined areas between walls while it is hot (31-31'-31"). These areas are, basically, the stripe (17) linked with the principal wall (14) and the transversal wall (15'), that of the paired-brims (23') and (23); that of the folds (10-10'-11) which shape the wings which in FIG. 12 are indicated by (24) and (24'), and the folding self-adhesive areas, as indicated in FIGS. 13, 16 and 17.

Figures 2, 3:
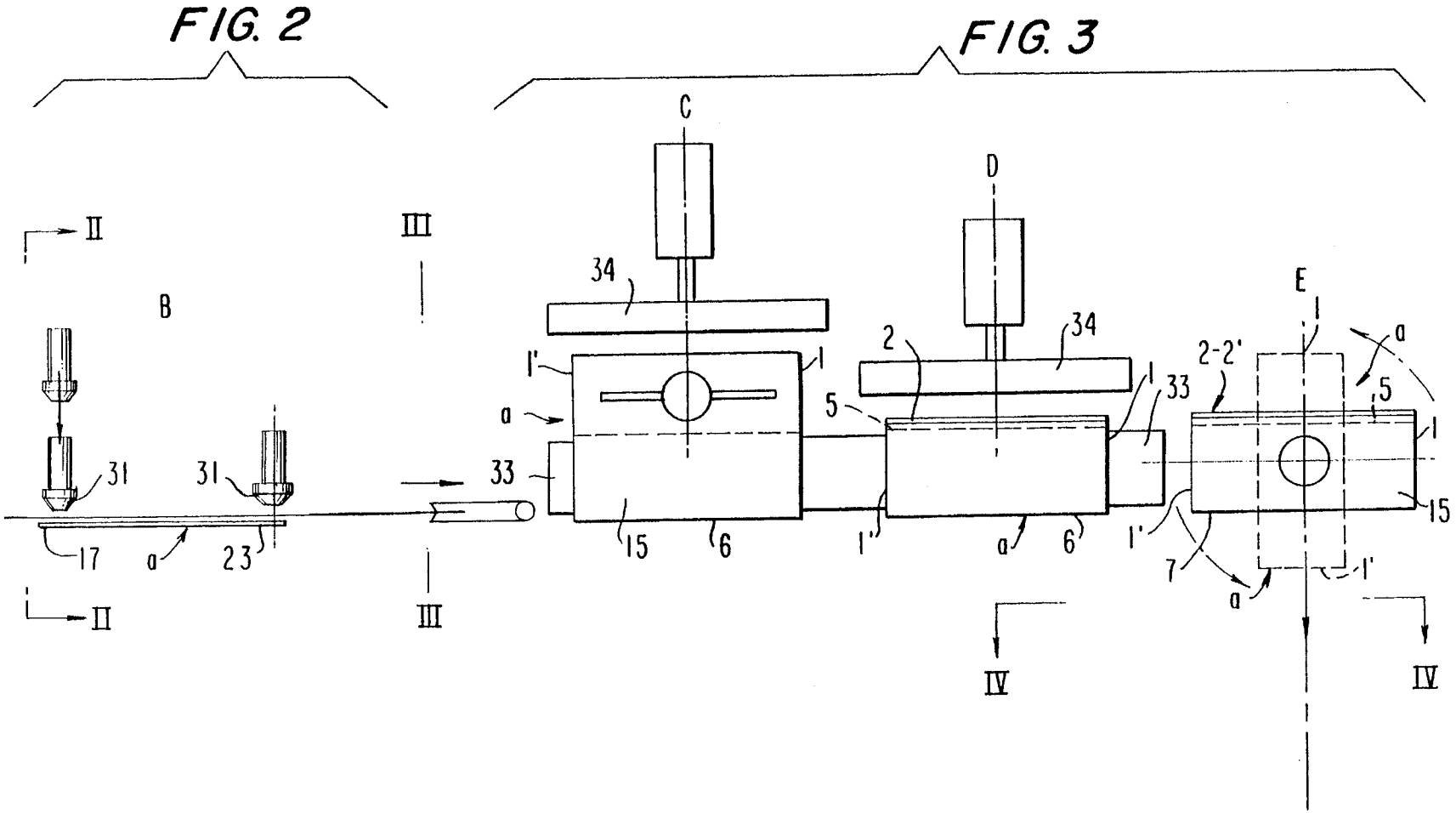
FIG. 2 shows the application of the thermo-activated adhesive on the corresponding parts of the package.
FIG. 3 shows the shaping and folding of the lateral walls of the package.

During step (C), FIG. 3, and by means of a prismatic rectangular shaping mandrel (33) equal to the cavity of the package to be shaped, the cardboard sheet (a) with its adhesive stripe (17) is folded until said stripe (17) overlaps with the inside of the part adjacent to the brim (2), step (D), pressing by means of a press (34), which should be heated in order to activate the adhesive substance; finally, the tube-shaped package is finished, as it is shown in FIG. 11.

After this, the shaping mandrel (33) is made to rotate (step E, FIG. 3) so that the longitudinal geometric axis of the tube is almost in a vertical position, so that the openings become the bottom (24) and the top part (24') of the package. The package is then taken to a mold (35) which shows the shaped tube (30) as indicated by the dotted line. As the closures are defined the continuous lines are drawn.

Figures 4, 7, 8, 9:
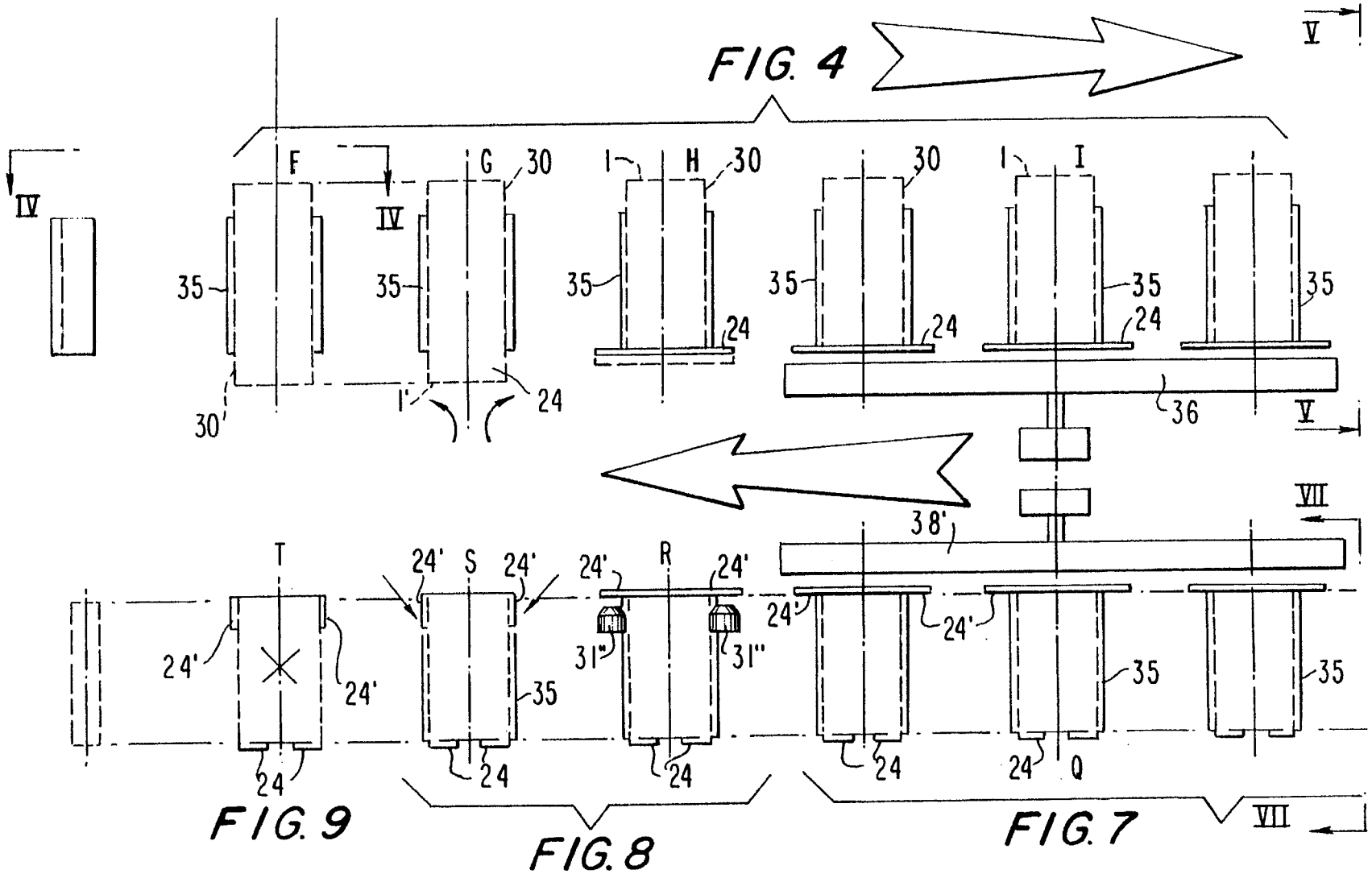
FIG. 4 shows the shaping step and the bottom sealing step.
FIG. 7 shows how the folding and the sealing of the wings around the package mouth are carried out.
FIG. 8 shows the final gluing and folding of the wings.
FIG. 9 shows a diagram of the package already shaped, closed and filled with its corresponding load during the last step of the manufacturing process.

Upon completion of this step, the brims (24) are glued (FIG. 4), heating them and making them overlap. The same procedure is carried out with the lugs that result from folds (10), (10') and (11), pressing on the table (36), and finally, making the resulting triangular lugs rotate against the flat bottom (24); said lugs are then pressed according to FIG. 5, steps (J), (K), (L). In this way, the lower part is closed and gives shape to the abovementioned bottom (24).

Figures 5, 6:
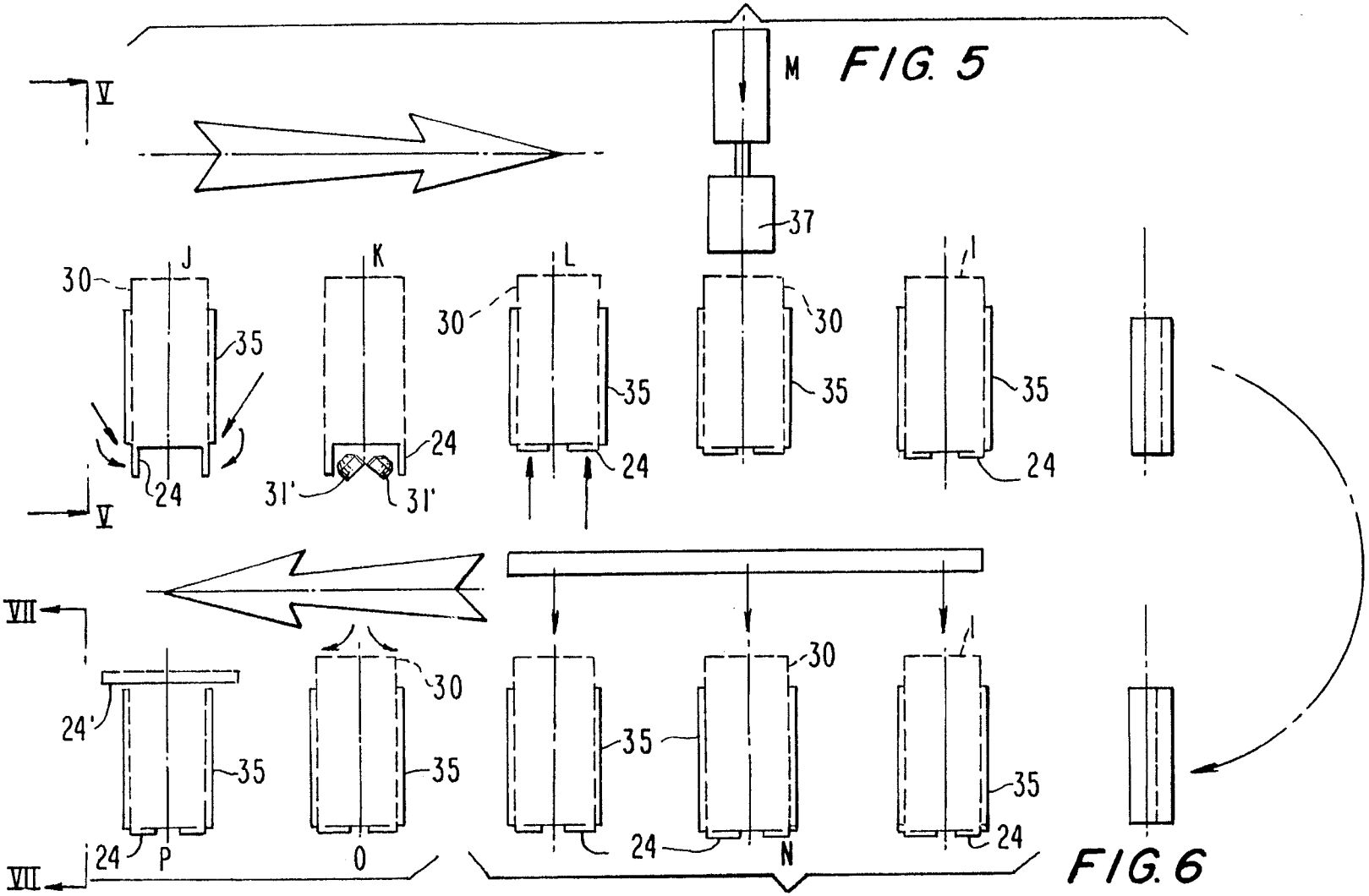
FIG. 5 shows how the bottom folds are pressed, in order to finally shape the bottom.
FIG. 6 shows how the package is filled with the corresponding load.
Figure 14:
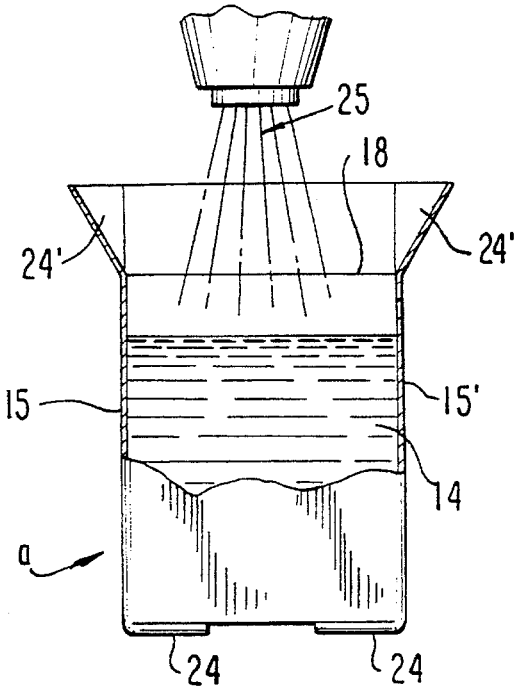
FIG. 14 shows an elevation view and a partial section of the package, during the filling of the solid product (granules, dusts, etc.)
Figure 15:
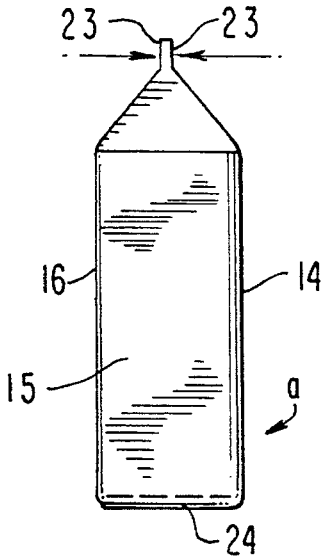
FIG. 15 shows how, after being filled, the opening is closed by gluing the brims of said opening.

After this, the package is filled with the solid product (25) (granules, dusts, etc.) according to FIGS. 6 and 14 through the upper opening (24') (FIG. 12). However, before filling it, it should be filled with the load of the product (25) to be packed, the brims (23) are sealed—FIGS. 7 and 15—and after making the corresponding folds, the opening wings (24') (FIGS. 8 and 16) will appear. After gluing the internal parts adjacent to said wings, the wings are folded according to FIGS. 9, 16 and 17. Finally, the airtight closure of the package is defined with the contents thereof (25) by activating the adhesive substance in the overlapping stripes with heat (17-31-31'-31").

The adhesive substance can also be activated by means of short wave, ultrasound or a similar technique. Similarly, the sterilization process can be carried out by means of either ultraviolet rays or gamma rays.

It is apparent that various modifications can be made in the shaping and assembly of this invention without departing from the inventive concepts herein as defined in the appended claims.

Having described the invention in detail and by reference to the preferred embodiment thereof, what is claimed is:

1. A method for the manufacturing of an airtight, recyclable and biodegradable package, wherein each package is made from a sheet and has: lateral walls which are glued in order to shape a tube; bottom folding walls, stamped with folding lines which close a first end of said tube making a container for a product, that is the load of the package; as well as top walls, with their corresponding folding lines and lugs, which shape a second end of the tube, in such a way that the product loaded therein is occluded; characterized in that: a cardboard sheet which is stamped so that the folding lines form lateral walls, a top wall, and a bottom of the package as well as adhesive bands; a fast-drying reactivating substance is applied on the adhesive bands; the cardboard sheet is folded along the adhesive bands thereof, making said adhesive bands overlap in pairs until the lateral walls of the package are tube-shaped, the adhesive substance is activated in order to secure the walls in question; the first one of said ends of said tube is formed by folding the bottom walls and activating the fast drying reactivating substance at said first end in order to shape a flat base, and after filling the package with the corresponding load, the second one of said ends of said tube is formed by folding the top walls, and the adhesive substance is activated to define the airtight closure once the adhesive in the overlapping bands has been activated.

2. A method for the manufacturing of the airtight, recyclable and biodegradable package of claim 1 wherein a cardboard sheet is used, stamped so that the folding lines limit the lateral walls, the top wall and the bottom of the package, as well as the adhesive bands among the walls; said sheet is sterilized; a fast-drying reactivating substance is applied on the adhesive bands between the walls; the cardboard sheet is folded along the corresponding folding lines, as long as the adhesive bands overlap with the limits of the lateral walls; the adhesive in said bands is activated in order to define the tube-like shape of said walls; the corresponding folding lines in the bottom of the package are folded, and the adhesive in the adhesive bands that overlap with said walls is activated in order to define the bottom of the package, at the same time it is folded to define a flat base; said package is closed, and the opening thereof is closed by folding the top walls and activating the adhesive substance applied in the respective bands.

3. A method for the manufacturing of the airtight, recyclable and biodegradable package of claim 1, characterized in that: a cardboard sheet is stamped with a continuous line to mark the folding lines which limit the lateral walls, the top walls, and the bottom of the package as well as the adhesive bands between the walls; said sheet is sterilized; a hot fast-drying adhesive substance is applied in the adhesive bands between the walls; the stamped cardboard sheet is placed in a shaping mandrel, in such a way that the adhesive bands that limit the lateral walls overlap, until a tube-like container is shaped; the adhesive in that area is thermo-activated by the pressing of heating clamps; the tube is taken to a vertical mold where one of the ends of said tube is shaped by overlapping the adhesive bands of the bottom, by thermo-activation of the adhesive substance thereof and by the pressing of heating clamps; the walls of said bottom are folded so that a flat bottom is shaped; the container is filled with the product to be packed; the other end of the lateral walls is closed, by activating the adhesive substance and by folding the top walls, so that a flat top is shaped so that the product is occluded inside the airtight package.

4. A method for manufacturing the airtight, recyclable and biodegradable package of claim 2, characterized in that: three of said adhesive bands correspond to the lateral walls, as well as the top walls and the bottom, respectively, each respective one of said adhesive bands overlapping with the limits of a respective wall, said adhesive being simultaneously applied to said three adhesive bands.

5. A method for the manufacturing of the airtight, recyclable and biodegradable package of claim 1, wherein the adhesive substance used is joiner's glue.

6. A method for the manufacturing of the airtight, recyclable and biodegradable package of claim 2, wherein the sterilizing means used is sodium peroxide.

7. A method for the manufacturing of the airtight, recyclable and biodegradable package of claim 2, wherein the cardboard sheet is sterilized by means of ultraviolet rays or gamma rays.

8. A method for the manufacturing of the airtight recyclable and biodegradable package of claim 6, wherein the cardboard sheet is sterilized by spraying with sodium peroxide.

9. A method for the manufacturing of the airtight recyclable and biodegradable package of claim 1, wherein the sheet is stamped, thus defining the folding lines of a large number of packages to be shaped; said stamped sheet is rolled up, and an adhesive applicator is fed-in with said sheet in a continuous way; the adhesive is applied hot in three adhesive bands—which overlap in pairs—which correspond to the limits of the lateral walls as well as the top walls and the bottom, respectively; the sheet is then fragmented by means of cutting cross lines, from which the stamped sheets with folding lines are obtained to make the packages; each fragmented stamped cardboard sheet is then placed in a shaping mandrel, so that the adhesive bands which limit the lateral walls overlap; so that a tube is made; the adhesive substance is activated in said area by pressing of a heating clamp; the tube is then taken to a vertical mold on which one of the ends is closed by making the adhesive bands of the bottom overlap, thermo-activating the adhesive by means of heating clamps; the bottom walls are folded so as to shape a flat base; the container is then filled with the product; the other end is closed, by activating the adhesive, by folding the top walls in the same way as the bottom walls, so that the product is finally occluded in the package.

10. A method for the manufacturing of the airtight recyclable biodegradable package of claim 1, wherein the cardboard sheet has also a waterproof layer.

11. A method for the manufacturing of an airtight, recyclable and biodegradable package wherein each package is characterized in that the package has lateral walls which form a tube, bottom folding walls which by means of folds and folding lines close a first end of said tube making a container for a product, that is the load of the package, and top walls which—with their corresponding folds and folding lines—close a second end of the tube, so that the packed product is occluded inside; characterized in that a cardboard sheet (a) is stamped to mark the folding lines which limit the lateral walls, the top walls and a bottom of the package, as well as adhesive bands; said sheet is sterilized; a fast-drying adhesive substance is applied on the adhesive bands between the walls; the cardboard sheet is folded so that the adhesive bands overlap in pairs so that the lateral walls form a tube; the first end is closed by folding the bottom walls making a flat base; and after filling the package with the product, the second end is closed by folding the top walls into a flat top; the adhesive in the adhesive bands is activated and therefore the filled airtight package is finally closed.

* * * * *